United States Patent [19]

Smith

[11] 4,376,281

[45] Mar. 8, 1983

[54] MULTIMODE ARRAY ANTENNA

[75] Inventor: Peter W. Smith, Westport, Conn.

[73] Assignee: United Technologies Corporation, Hartford, Conn.

[21] Appl. No.: 219,744

[22] Filed: Dec. 23, 1980

[51] Int. Cl.[3] ..... H01Q 13/10

[52] U.S. Cl. ..... 343/768

[58] Field of Search ..... 343/768, 770, 771

[56] References Cited

U.S. PATENT DOCUMENTS

| | | | |
|---|---|---|---|
| 3,247,512 | 4/1966 | Diamond | 343/771 |
| 3,286,260 | 10/1966 | La Var Howard | 343/100 |
| 3,305,867 | 2/1967 | Miccioli et al. | 343/113 |
| 3,604,012 | 9/1971 | Lindley | 343/768 |
| 3,893,124 | 7/1975 | Barker | 343/768 |
| 3,969,729 | 7/1976 | Nemit | 343/756 |
| 3,971,022 | 7/1976 | Lenz | 343/754 |
| 4,057,803 | 11/1977 | Coleman | 343/113 R |
| 4,121,220 | 10/1978 | Scillieri et al. | 343/771 |

*Primary Examiner*—Eli Lieberman

*Attorney, Agent, or Firm*—Richard P. Lange

[57] ABSTRACT

An array antenna having a plurality of radiating elements positioned in a planar configuration is divided into four separate quadrants. The array antenna is capable of being switched between two modes, a narrow pencil beam mode and a $\text{cosec}^2\theta\cos\theta$ mode, through the use of a single switch and a pair of phase shifters. In the pencil beam mode, the transmitted energy is symmetrically divided between the four quadrants of the antenna. By changing the switch to its second position the power is diverted to only the upper half of the antenna and a pair of phase shifters introduces a phase shift to the radiating elements along the lower half of the upper portion of the antenna. This causes an asymmetric radiation pattern from the antenna creating the $\text{cosec}^2\theta\cos\theta$ beam which is well suited for ground mapping.

10 Claims, 5 Drawing Figures

MULTIMODE ARRAY ANTENNA

DESCRIPTION

1. Technical Field

This invention relates to an array antenna for transmitting and receiving radar signals, and more particularly, to a planar array antenna capable of providing both a highly directive pencil beam with low side lobes, and also a $\text{cosec}^2\,\theta\cos\theta$ beam for mapping.

2. Background Art

Array antennas are known generally and comprise a plurality of radiating elements often positioned in a planar configuration. With some array antennas, the phase of a radar signal associated with the array elements may be electrically controlled by a plurality of phase shifters which are positioned in the path to each of the array elements so that the direction of the antenna beam can be scanned electronically.

The high frequency illuminating radar signal is typically produced by a transmitter whose output energy is presented to the antenna through a feed network. In that the radiating elements are typically formed on a flat surface, the direction or orientation of both the transmit and receive aperture is controlled by the phase of each of the radiating elements. In order to properly focus the radiating energy on a distant target, the phase delay to all radiating elements must be equalized.

A particular known advantage array antennas is that they are capable of creating a particularly shaped beam which is well suited to one type of use. An example of this is a narrow pencil beam which is highly directive and has low side lobes such that it is well matched to a pulse doppler air-to-air search and track radar, or to a synthetic aperture ground mapping radar or to a radar with the capability of doppler beam sharpening and/or spot-lighting. For other applications, such as ground mapping a beam shape which has return signal of constant power to the receiver independent of range is desirable, this illuminating beam being the well-known $\text{cosec}^2\,\theta\cos\theta$ beam.

A number of prior art techniques are known for obtaining multimode operation with a single radar antenna, and each of these techniques has a different tradeoff of characteristic, such as beam width, side lobe level, size, cost, etc. One such scheme includes a parabolic reflector with a retractable spoiler extending over part of its surface that redirects a portion of the power toward the ground when fully deployed. Another technique involves the use of a reflector with front and rear surfaces. The front surface is parabolically shaped. The antenna reflects energy with a vertical polarization from the front surface while transmitting horizontally polarized energy from the rear surface to form the ground map beam. Yet another method uses a reflector with two surfaces. The front surface is formed of a microwave transparent plastic material and a metallized rubber skin is positioned between the surfaces. This skin conforms and adheres to one surface or the other depending on the state of pressure differential across the membrane. A particular problem with the aforementioned reflector-type antenna is that they are not generally capable of multimode operation while still providing the required efficiency and low side lobe levels that are necessary to form a good pencil beam. Accordingly, the array antenna is the type of antenna best suited to providing the necessary performance characteristics for multimode use. However, array antennas are not without a number of limitations. An array antenna necessarily requires a large number of phase shifters, as many as one per radiating element, and this component introduces both power losses and phasing errors. Changes in both temperature and power levels to a phase shifter further increases the nature and type of error which must be considered. Probably most significant in airborne operations, are the high weight, massive size and cost of the electronically phased antenna array.

DISCLOSURE OF INVENTION

It is an object of the present invention to provide a simple, low cost array antenna for an airborne radar capable of multimode operation in providing both a pencil beam and also $\text{cosec}^2\,\theta\cos\theta$ beam.

According to a feature of the present invention, an inexpensive array antenna includes only a single waveguide switch and two waveguide phase shifters that switch the array antenna between its two distinct modes. A first mode provides a highly directive, narrow beam with low side lobes and monopulse capability. A second mode is a $\text{cosec}^2\,\theta\cos\theta$ beam to give returns of constant intensity from the ground out to maximum range in an aircraft.

According to the present invention, an array antenna uses only a single waveguide switch to shift between a pencil beam with low side lobes and a $\text{cosec}^2\,\theta\cos\theta$ beam. The antenna is divided into four quadrants for monopulse operation and includes two waveguide mounted phase shifters positioned in the feed structure to two quadrants.

According to one aspect of the present invention, an array antenna comprised of a plurality of radiating elements positioned in a planar configuration is capable of being switched between two modes through the use of a single waveguide switch and a pair of phase shifters. The first mode is a pencil beam mode with monopulse capability and the switch is in a first position that allows the transmitted energy to be equally divided between the upper and lower halves of the antenna. In this first mode, the phase shifters are set to zero. To switch to the other mode, the switch is changed to its second position causing the illuminating power to be directed only to the upper half of the antenna, and at the same time the phase shifters are set to introduce a phase shift of approximately 60° to the energy to the radiating elements along the bottom row of the upper half of the antenna. This causes an asymmetric radiation pattern from the antenna in which the radiation pattern from the upper half of the antenna has been modified by the radiation from the phased stick. This asymmetric radiation pattern is the well-known $\text{cosec}^2\,\theta\cos\theta$ beam which is well suited for ground mapping.

According to the present invention, a four-quadrant array antenna includes an aperture plate having a plurality of laterally extending sticks which include apertures in the front wall that form radiating elements for the radar signal. The feed structure for the upper half of the array antenna is divided into two parts; and a pair of phase shifters are positioned in the waveguides that feed the laterally extending sticks at the bottom of these two quadrants. A switch positioned in the waveguide from the transmitter has two positions, one of which equally divides the illuminating power between the four quadrants, and the other position directs the radiating energy only to the upper half of the antenna. By symmetrically presenting all of the radiating energy to the four quadrants of the antenna, a narrow pencil beam with low side lobes is formed. In the second position, the power is diverted to the two quadrants in the upper half of the antenna causing an asymmetric radiation pattern in which the pattern from the upper half of the antenna has been modified by the radiation pattern from its lowest, phased stick.

The foregoing and other objects, features and advantages of the present invention will become more apparent from the following description of preferred embodiments and accompanying drawings.

BEST MODE FOR CARRYING OUT THE INVENTION

Figure 1:
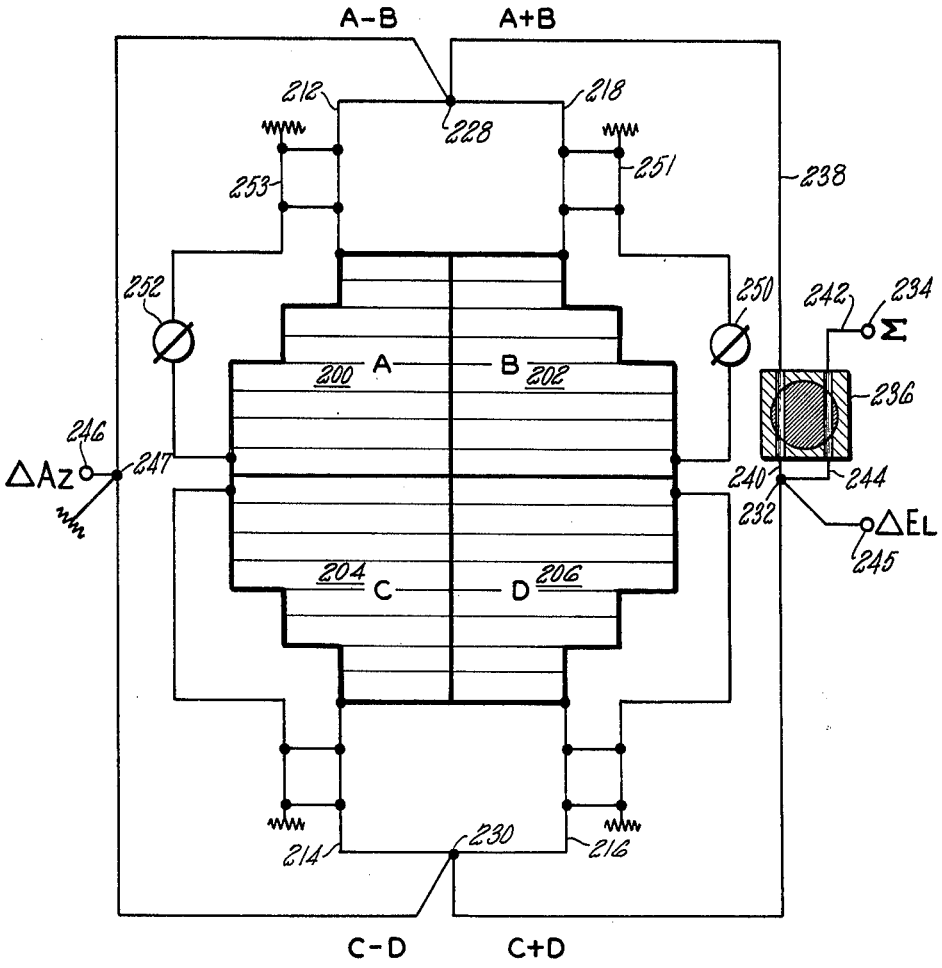
FIG. 1 is a schematic diagram of a multimode array antenna according to the present invention, and shows the four quadrants of the antenna aperture together with basic components of the array antenna.

Referring initially to FIG. 1, there is seen a schematic illustration of one embodiment of a multimode array antenna according to the present invention. This planar array antenna is capable of switching between two distinct modes, one of which provides a narrow pencil beam with low side lobes and the other provides a $\text{cosec}^2\,\theta\,\cos\theta$ beam.

The array antenna is an aperture for electromagnetic energy and is essentially divided into four quadrants, upper-left quadrant 200, upper-right quadrant 202, lower-left quadrant 204, and lower-right quadrant 206. Each quadrant is fed by a separate intermediate feed. An intermediate feed 212 and an intermediate feed 218 are for the upper-left quadrant 200, and upper-right quadrant 202, respectively, and as such feed all of the radiating elements of upper half of the array antenna. In a similar fashion, an intermediate feed 214 and an intermediate feed 216 supply the lower-left quadrant 204 and the lower-right quadrant 206, respectively, and together feed all of the radiating elements of the lower half of the array antenna. A power divider, such as a magic tee 228, is provided for the upper half of the antenna and it has one leg of waveguide connected to the intermediate feed 212 and another leg of waveguide connected to the intermediate feed 218. In a similar fashion, a power divider, such as magic tee 230, is provided for the lower half of the array antenna and has one leg of waveguide connected to the intermediate feed 214 and another leg of waveguide connected to intermediate feed 216. In turn, a power divider, such as a magic tee 232, is provided and has a separate leg of waveguide connected to both the magic tee 228 and the magic tee 230. One leg of the magic tee 232 is also connected to a sum port 234, this being the port through which energy for the illuminating radar beam propagates. A switch 236 is provided and includes four ports, one of which is connected to the magic tee 228 by a waveguide 238, and another of which is connected by a waveguide 240 to the magic tee 232. The other two ports of the switch 236 are connected to the sum port 234 by a waveguide 242 and one leg of the magic tee 232 by a waveguide 244. The switch 236 has a first position in which radar energy for the illuminating beam is divided equally between the upper and lower halves of the antenna. In this position, energy from the transmitter passes through the sum port 234, the waveguide 242, the switch 236, and the waveguide 244 to the magic tee 232 where it is divided equally for presentation to the upper and lower halves of the array antenna. In its second position, the switch connects the waveguide 242 to waveguide 238 so that the energy from the transmitter is presented to just the magic tee 228 and the illuminating radar beam is only from the radiating elements of the upper half of the array antenna.

An elevation monopulse difference port 245 is provided for making monopulse measurements in elevation. An azimuth monopulse difference port 246 is also provided for making monopulse difference measurements in azimuth. The elevation monopulse difference port 245 is connected to one leg of the magic tee 232. The monopulse difference port 246 is connected to a power combiner 247 which, in turn, has legs which are connected to the magic tee 228 at the upper end of the antenna and the magic tee 230 at the lower end of the antenna.

Two phase shifters, phase shifter 250 and phase shifter 252 are provided so that the phase of the radiating elements at the bottom portion of the upper half of the antenna can be phase shifted simultaneously when the switch 236 is changed between its first and second position. A directional coupler 251 is connected in the intermediate feed 218 for feeding the lowest stick in the upper-right quadrant 202 and a directional coupler 253 is connected in the intermediate feed 212 for feeding the lowest stick in the upper-left quadrant 200. The phase shifters 250 and 252 are mounted on the respective waveguides between the directional coupler and each lower waveguide stick.

It will be appreciated by those of ordinary skill that it is believed that the physical arrangement of a planar array antenna according to the present invention could be designed and constructed from the information presented hereinbefore. However, in order to ensure a clear understanding of the present invention, one embodiment of an array antenna according to the present invention will now be described.

Figure 2:
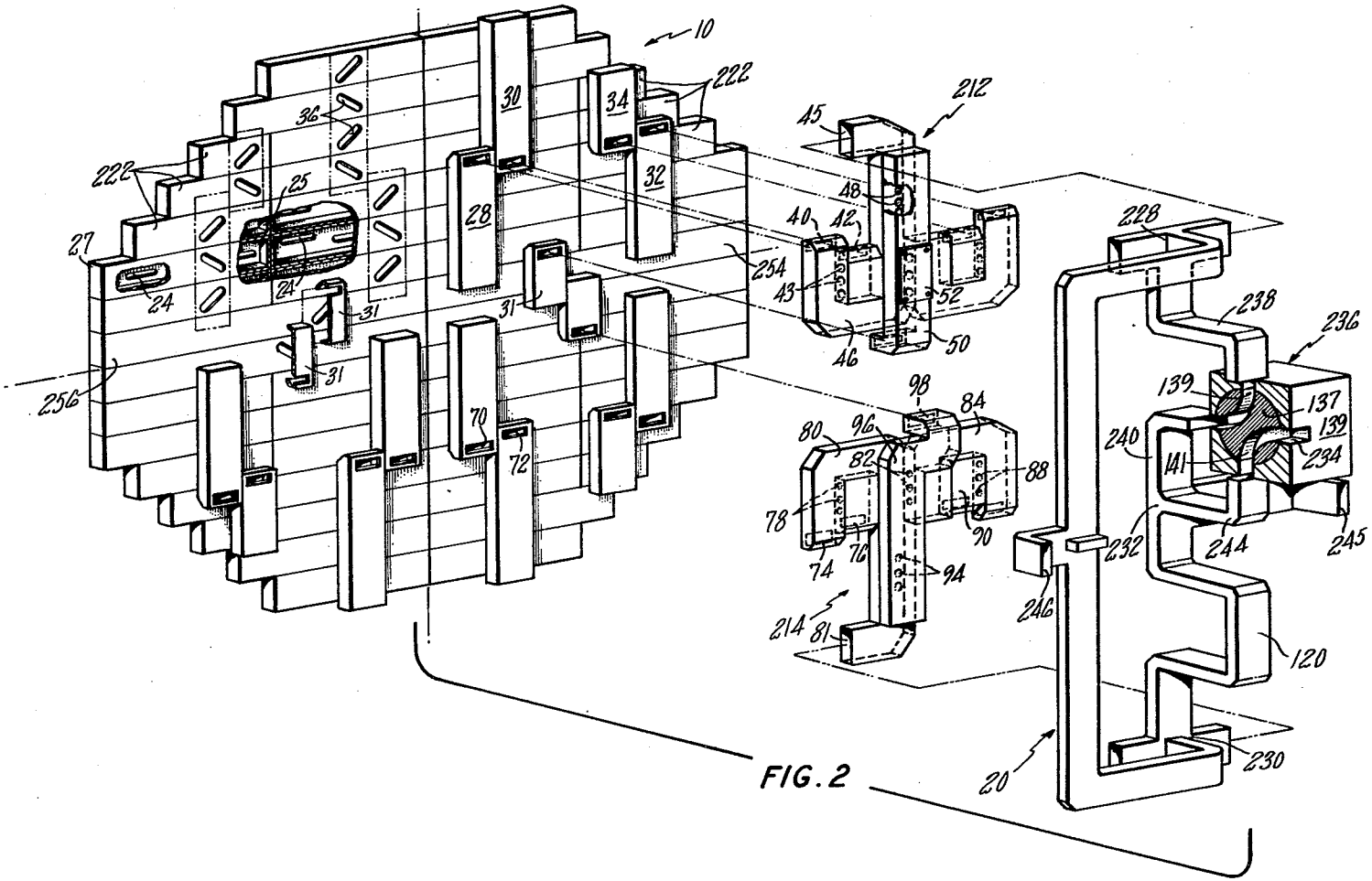
FIG. 2 is an exploded view of one embodiment of a multimode array antenna according to the present invention and shows the front aperture plate, two of four intermediate feeds, and the switch structure.

Referring now to FIG. 2, there is seen an exploded view of one embodiment of a multimode array antenna according to the present invention. The array antenna essentially comprises an aperture front plate 10; an intermediate feed of which there are four separate portions, intermediate feed 212, intermediate feed 214, and two more similar portions which are not shown. A switch structure 20 is located at the rearward portion of the antenna and connects with the intermediate feed. As mentioned, the array antenna is essentially divided into four quadrants, each of which is fed by one of the intermediate feeds. Each quadrant consists of a number of waveguides or sticks 222 which extend laterally outward from an end wall (not shown) positioned along the cneter of the antenna, the wall being generally vertical axis.

Each stick 222 is in fact a waveguide through which microwave energy propagates to, or from, a target. Each stick 222 includes a number of slots 24 which are formed in the front of the aperture 10 one-half wavelength apart and these slots are apertures through which microwave energy propagates. The overall length of each stick is sized in accordance with the wavelength of the radar signal that propagates therethrough being resonant at the design frequency. Each laterally extending stick 222 of a first group is fed by feed sticks 28 and 30 which extend from the bottom of this quadrant midway to the top, and from midway in the quadrant to the top, respectively. Another pair of feed sticks, stick 32 and stick 34, are also provided and are positioned laterally outward from sticks 28 and 30 to feed a second group of laterally extending sticks 222. Each of the vertical feed sticks communicate through an opening 36 (shown in the upper left quadrant), and this opening acts as an aperture through which microwave energy propagates to the laterally extending sticks 222. The base stick 256 in each quadrant is located next to the horizontal centerline and is continuously open all the way from the end wall along the vertical centerline 24 to the outward end of each antenna. This base stick 256 has a separate vertical feed stick 31 so that the phase shifter can be positioned in the pathway to the base stick.

Referring still to FIG. 2, as mentioned before each of the quadrants of the array antenna includes a separate intermediate feed through which radar signals propagate to, and from the radiating elements in the front aperture plate 10. The intermediate feeds on each side of both the upper half and lower half of the antenna are symmetric. One of these two intermediate feeds, intermediate feed 212, will now be described. The intermediate feed 212 has ports which are aligned with the ports on each of the feed lines which extend vertically along the back of the aperture plate 10. For example, the ports in the feed 28 and 30 align with comparably sized ports in the waveguides 40 and 42. A directional coupler is formed by an aperture 43 in the side wall between the waveguides 40 and 42 and a waveguide 46 leads around a U-shaped path to an opening 45 which connects with the switch structure 20.

Another directional coupler is formed by an aperture 48 positioned in the top wall of the waveguide and microwave energy propagates therethrough to the upper section of the waveguide that connects with the switch structure 236. A waveguide 50 attached to the lower end of the directional coupler 48 includes a mounting 52 which is adapted to have a phase shifter (not shown) positioned thereon. If a dielectric vane-type phase shifter is used, a slot is provided and creates an opening into the interior of the waveguide for a dielectric vane. A waveguide 50 leads from the lower end of the mounting 52 to the port in the face of the vertical feed 31 for feeding the base stick 254.

One of the two symmetrically shaped intermediate feeds, intermediate feed 214, for the quadrants of the lower half of the array antenna will now be described. The intermediate feed 214 has several ports which are aligned with the ports on each of the feed lines which extend vertically along the back of the aperture plate 10. For example, the ports 70 and 72 align with the comparably-sized ports in the end of the waveguides 74 and 76. A directional coupler formed by aperture 78 is an opening in the common side wall through which microwave energy can be coupled. A U-shaped waveguide 80 leads to an opening 81 which is connected to the switch structure 20. An aperture 82 forms a directional coupler and leads to a U-shaped waveguide 84 that has a port at its outward end which aligns with the port on a vertical feed. An aperture 88 in the side wall of the waveguide 84 leads to a waveguide 90. The waveguide 90 has a port at its outward end that, together with the port at the outward end of waveguide 84 couple energy to the vertical feed sticks of the second and third groups of sticks 222 in this quadrant. An aperture 94 forms a directional coupler to a waveguide 96 that leads to the upper end of the quadrant; and a port at the end of the waveguide 98 is for coupling energy into the base stick 30 of this quadrant 14.

Referring still to FIG. 2 in addition to FIG. 1, as mentioned herebefore, the switch assembly 20 is located at the rearward portion of the array antenna and includes the switch 236 that, together with the phase shifters 250 and 252 (FIG. 2), are transitioned between a first and second position to switch the beam of the antenna between its narrow pencil beam mode and its $\text{cosec}^2\,\theta \cos\theta$ beam mode. The switch 236 includes a rotor 137 which is rotatably positioned in a housing 139. The rotor 137 includes a first curved waveguide 139 and a second curved waveguide 141 which extend between ports which are spaced along the circumference of the rotor side wall by 90°. The housing 139 communicates with the waveguide 238 which extends from the housing top, and also with the waveguide 240 which extends from the rear of the housing. The waveguide 244 extends from the bottom of the housing to the magic tee 232. In the position shown in FIG. 2, the switch 236 is in the pencil beam mode such that the input power from the transmitter is presented to the sum port 234 and the waveguide 244. At the magic tee 232, power is divided equally to the upper and lower halves of the antenna. Accordingly, power then propagates via a waveguide 240, a waveguide 139 in the rotor 137, the waveguide 238 and the magic tee 228 to the upper half of the array antenna. Power to the lower half of the antenna propagates from the magic tee 232 down waveguide 120 to the magic tee 230.

The elevation monopulse difference output port 245 is connected by a short section of waveguide to one leg of the magic tee 232. The azimuth monopulse difference port 246 is connected through the magic tee 247 to the upper and lower halves of the antenna.

Although one embodiment for the multimode array antenna has been described in detail, it should be understood that there are numerous other embodiments which could be constructed in accordance with the teachings of the present invention. For example, the just described embodiment is well suited to a configuration in which the aperture plate 10 is approximately 20 inches in diameter and the operating frequency of the radar is in the X-band range. However, if an antenna with a larger aperture plate 10 is desired for operation in the X-band frequency range, a slightly different configuration would probably be necessary. In such a case, the sticks to which the phase shifters are connected might not be located along the axis of the antenna, but rather might be midway between the top and center of either halves of the array antenna. In such a case, two waveguide switches would probably be required, one for each of the smaller quadrants of the antenna.

In operation, it will be understood by those of ordinary skill that the multimode array antenna of the present invention is normally but one component of a radar system. Such a radar system typically includes a transmitter, which would be connected to present a pulse of radar energy to the sum port 234, and one or more receivers. One receiver could be connected to the sum port 234 while other receivers could be connected to the elevation monopulse difference port 245 and the azimuth monopulse difference port 246.

It should be understood that if the array antenna according to the present invention were used in an aircraft, or the like, it normally would be positioned so that it could be mechanically scanned in elevation and azimuth by a motor-driven support structure (not shown). If the requirements of the radar system were such that the aperture plate were rotated at a relatively low rate, then the waveguide switch 236 and the phase shifters 250 and 252 could be selected to correspond to such a scan rate. In other words, the switch 236 and the phase shifters 250 and 252 could be of the relatively inexpensive mechanical type of unit which requires a rather long period of time to transition between the first and second positions to change the antenna radiation pattern between its two modes. Of course, if the switch rate of the aperture is high, then the waveguide switch 236 and the phase shifters 250 and 252 will necessarily have to be selected such that the transition time between the two positions is shorter, for example, by the use of electronic switches and phase shifters making use of diodes or ferrites.

Figure 3:
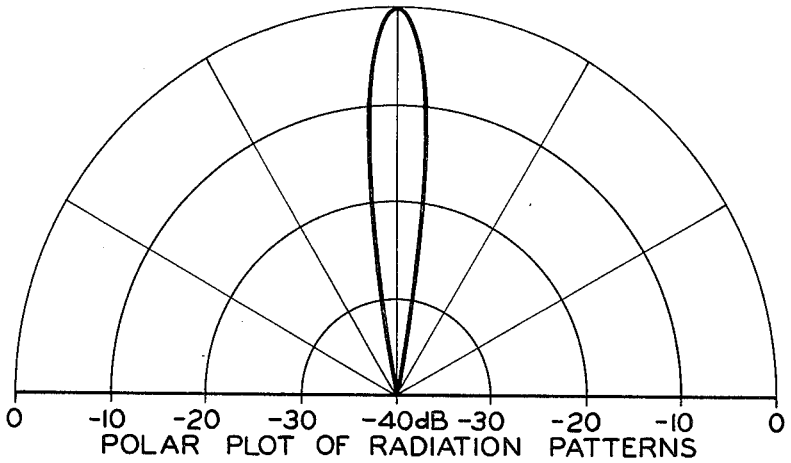
FIG. 3 is a drawing depicting the radiation pattern of the array antenna in one of its two basic modes, the pencil beam mode.

Referring now to FIG. 3, there is seen a polar plot depicting one of the two radiation patterns of the multimode array antenna according to the present invention, this mode being the pencil beam mode. As is seen, the beam 270 generated by the array antenna is essentially a narrow, pencil beam with extremely low side lobes which is symmetric in elevation and azimuth. In the idealized case as shown, the side lobes are typically below 40 db; but it will be appreciated by those of ordinary skill that in the construction of an antenna according to the present invention, mechanical tolerances are inherent and the resultant phase errors would normally increase the side lobe level.

Figure 4:
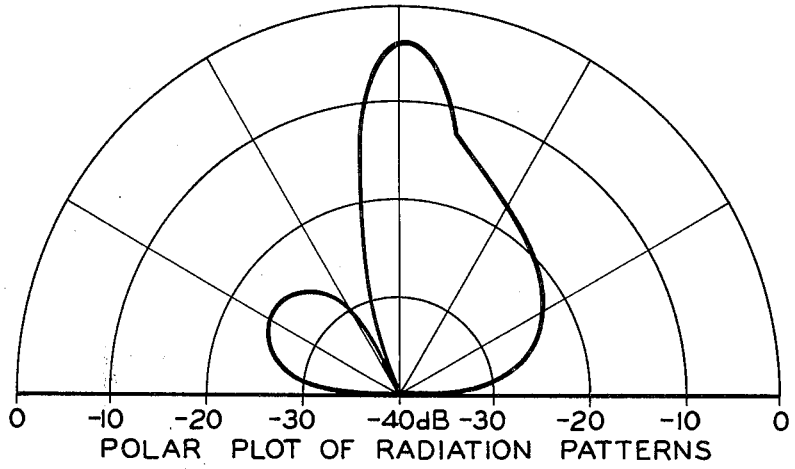
FIG. 4 is a graph depicting the radiation pattern of the multimode array antenna in the second of its two basic modes, the $\text{cosec}^2\,\theta\,\cos\theta$ mode.

Referring next to FIG. 4, there is seen a polar plot of the radiation pattern in elevation of the multimode antenna according to the present invention in the second of the two modes, the $\text{cosec}^2\,\theta\,\cos\theta$ mode. As briefly mentioned herebefore, this radiation pattern is well suited for use in ground mapping because of the fact that the returns are of a relatively constant intensity from low elevation angles out to the horizon.

Figure 5:
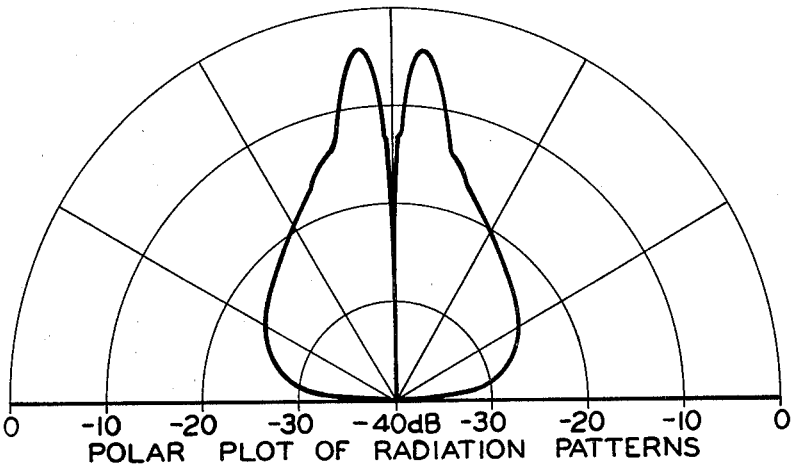
FIG. 5 is a drawing depicting the monopulse difference radiation pattern of the multimode array antenna, this being the pattern at either the elevation monopulse difference port or at the azimuth monopulse difference port.

Referring finally to FIG. 5, there is seen a polar plot of the monopulse difference pattern of the multimode array antenna according to the present invention. This is an idealized plot that could be either from the elevation monopulse difference port 245 or the azimuth monopulse difference port 246.

Although this invention has been shown and described with respect to a preferred embodiment, it will be understood by those skilled in this art that various changes in form and detail thereof may be made without departing from the spirit and scope of the claimed invention.

I claim:

1. An array antenna connectable to an input/output port for forming an aperture to transmit or receive radar signals, said array antenna being switchable between at least two modes, comprising:

aperture means having an upper portion and a lower portion, each including a plurality of laterally extending waveguides with a number of radiating elements disposed thereon;

a lower intermediate feed means communicating with each of said laterally extending waveguides of said lower portion of said aperture means, for dividing the energy of an illuminating radar signal among, or for combining the energy of a received radar signal from, said laterally extending waveguides;

upper intermediate feed means communicating with each of said laterally extending waveguides of said upper portion of said aperture means, for dividing the energy of an illuminating radar signal among, or for combining the energy of a received radar signal from, said laterally extending waveguides; and switch means having at least a first position and a second position, and connected between said input/output port, and said lower intermediate feed and said upper intermediate feed for coupling radar signals;

whereby when said switch means is in said first position, said input/output port is connected to both said upper intermediate feed and said lower intermediate feed causing said array antenna to be in its first mode, and when said switch means is in said second position, only one of said intermediate feed means is connected to said input/output port causing said array antenna to be in its second mode.

2. An array antenna according to claim 1, wherein there are two upper intermediate feed means and also two lower intermediate feed means, each of which is connected to a power combiner/divider.

3. An array antenna according to claim 1, further including a phase shifter means positioned in the feed path to the laterally extending waveguides at the lower end of said upper portion of said aperture means, and wherein said phase shifter is transitioned between a first position and a second position simultaneously with said switch means such that in said first position said phase shifter causes no phase shift in the radar signal to/or from the laterally extending waveguides at the lower end of said upper portion of said aperture means, and in the second position said phase shifter causes a phase shift in the radar signal to said laterally extending waveguides at the lower end of said upper portion of said aperture means.

4. An array antenna according to claim 3, wherein said phase shift introduced by said phase shifter in said second position is approximately 60°.

5. An array antenna according to claim 3, wherein there are two upper intermediate feed means, each of which includes a mounting upon which said phase shifter can be fixedly attached.

6. An array antenna according to claim 1, wherein said upper portion and said lower portion of said aperture means are connected to a first power combiner having a sum and difference port, and wherein an elevation monopulse difference port is connected to said difference port of said first power combiner for making monopulse elevation measurements.

7. An array antenna according to claim 1, wherein said upper portion and said lower portion of said aperture means are connected to a second power combiner having a sum and difference port, and wherein an azimuth monpulse port is connected to said difference port of said second power combiner.

8. An array antenna according to claim 1, wherein said switch means is connected to said upper intermediate feed means and said lower intermediate feed means by sections of waveguides which terminate in ports within the housing of said switch means, and wherein said switch means is switched to change said array antenna between said first mode and said second mode.

9. An array antenna according to claim 1, wherein said first mode is a pencil beam mode with low side lobes and monopulse capability.

10. An array antenna according to claim 1, wherein said second mode is a $\text{cosec}^2\,\theta \cos\theta$ beam mode.

* * * * *